United States Patent [19]

Willbanks et al.

[11] 4,388,518

[45] Jun. 14, 1983

[54] ELECTRIC SURFACE HEATER ASSEMBLY

[75] Inventors: Henry O. Willbanks; Richard P. Johnson, both of Cookeville, Tenn.

[73] Assignee: Teledyne Still-Man Manufacturing, Cookeville, Tenn.

[21] Appl. No.: 333,106

[22] Filed: Dec. 21, 1981

[51] Int. Cl.[3] ..... H05B 3/68

[52] U.S. Cl. ..... 219/455; 219/463; 219/467; 219/541

[58] Field of Search ..... 219/451, 447, 455, 458, 219/461, 463, 467, 536, 541; 248/200, 205 R; 338/316

[56] References Cited

U.S. PATENT DOCUMENTS

| | | | |
|---|---|---|---|
| 2,938,989 | 5/1960 | Smith | 219/463 |
| 3,016,445 | 1/1962 | Lien, Jr. | 219/451 |
| 3,021,414 | 2/1962 | Sand | 219/451 |
| 3,024,345 | 3/1962 | Hanson | 219/455 X |
| 3,043,944 | 7/1962 | Hanson | 219/463 |
| 3,124,673 | 3/1964 | Yohe | 219/455 X |
| 3,174,028 | 3/1965 | Ammerman | 219/455 |
| 3,188,449 | 6/1965 | Hanson | 219/455 |
| 3,327,966 | 6/1967 | Jasionowski | 248/205 |
| 3,331,944 | 7/1967 | Burger et al. | 219/455 |
| 3,336,466 | 8/1967 | Cunningham | 219/451 |
| 3,350,674 | 10/1967 | Kozbelt et al. | 338/316 |
| 3,439,892 | 4/1969 | Meyer | 248/200 |
| 3,644,710 | 2/1972 | Drugmand et al. | 219/463 |
| 4,013,870 | 3/1977 | Summers | 219/451 |

*Primary Examiner*—Volodymyr Y. Mayewsky

*Attorney, Agent, or Firm*—Dennison, Meserole, Pollack & Scheiner

[57] ABSTRACT

A tubular heating element including a convoluted central heat generating portion with offset terminal legs extending from the free ends of the inner and outer convolutions, and a support spider freely underlying, and without direct securement thereto, the central heat generating convoluted portion. The spider includes a central support arm extending diametrically across the convoluted center of the heating element generally aligned between and parallel to the terminal legs of the heating element. The end of the central arm adjacent the legs is laterally directed to form an abutment against which the vertical portion of the outer of the terminal legs engages. The heating element, beyond the convoluted central portion, includes a connector having apertures for receiving the terminal inner and outer legs therethrough. The connector includes a boss affixed thereto surrounding the aperture receiving the inner leg, which boss is crimped to the inner leg for a positive mounting of the connector. The outer leg is freely received through its corresponding aperture, the connector limiting lateral movement of the outer leg relative to the inner leg. Longitudinally inward movement of the outer leg is limited by the abutment defined on the support spider arm. The support spider is assembled to the tubular heating element by a bracket which includes a sleeve about the terminal end portion of the inner leg, and a vertical panel including a lateral offset and a vertical flange which is affixed to the overlying central arm of the spider.

11 Claims, 4 Drawing Figures

ELECTRIC SURFACE HEATER ASSEMBLY

BACKGROUND OF THE INVENTION

The invention is directed to electric range heater assemblies which conventionally incorporate a tubular heating element and a support or support spider affixed to the heating element for support thereof and manipulation of the assembly as a unit. The assembly will normally also incorporate a connector or grounding bracket engaged between the terminal legs of the heating element with the connector stabilizing the legs relative to each other and preventing shifting of the relatively more flexibly mounted outer leg, that is the leg associated with the outer convolution of the heating element.

At present, two basic heater assemblies are or have been commonly used. In the first assembly, the support or spider is staked directly to the convolutions of the central heating portion of the heating element in at least two places. This staking is basically affected by forming the support, or more particularly selected ones of the support arms, with upwardly projecting integral ear-like extensions which receive a portion of the tube therebetween and are subsequently deformed thereagainst or thereover. In some instances, the tube itself may be preformed at the point of staking to provide an improved profile for accommodation of the staking operation. Such a staking arrangement for the securement of a support to a heating element will be noted at the left-hand portion of FIG. 2 of the patent to R. E. Sand, U.S. Pat. No. 3,021,414. Other than for this illustration, the patent appears to make no reference to this relatively common manner of interconnecting a support to an overlying heating element.

While the staking procedure is widely used, it does give rise to several problems. For example, in order to achieve maximum holding strength, the extending portions of the support, those portions which are to be deformed or staked to the tubes, must reach well above the central plane of the tube to effect a positive retention. However, a restraining design consideration is that the extended portion of the support cannot project above the planar top surface of the tube after staking as this would prevent cooking vessels from sitting flat on the heater surface. The preforming of the tube at the point of staking, as previously referred to, is an attempt to improve the strength and consistency of the staking operation. However, this is an expensive procedure and can itself result in unacceptable disruptions in the tube.

Even in those circumstances wherein all of the appropriate staking dimensions are maintained within specifications, the force of actually deforming the support extensions into the tube often results in an upward "ballooning" of the planar top surface of the tube. Similarly, slight variations in the support spider, and in particular the positioning of the staking extensions, can result in deformations of the heater tube, and in particular the convoluted central heating portion.

Even under situations wherein the staking operation is mechanically correct, there is an inherent problem due to the disruption of the magnesium oxide inside the heater tube which results from each staking operation. This disruption tends to create a section in the heater with reduced heat transfer ability. This in turn can lead to premature failing of the heater.

Finally, the intimate contact, provided by the staking operation, between the support spider and the heater tube gives rise to an increased tendency for heat drain from the tube to the spider. This in turn decreases the efficiency of the heater and results in an uneven heat pattern.

The second conventionally used manner of attaching the support to the formed heater tube is through the use of a formed tie bracket or strap. Note for example the member 16 in the patent to L. S. Kozbelt et al., U.S. Pat. No. 3,350,674. Such a bracket, while overcoming many of the problems associated with a staking operation, gives rise to its own set of problems.

For example, the use of a welded bracket is costly both in material and labor. The welding of a tie bracket to a thin wall tube tends to result in a high level of scrap due to "blow holes." Further, the weld must be made through an oxide layer or the oxide must be removed by a separate brushing operation. Finally, the use of such tie brackets does not provide a firm assembly between the support and the formed tube, an anti-rattle device normally being utilized.

The Kozbelt et al. patent is also of interest in illustrating the connector or ground bracket, as widely utilized. This connector, designated by reference numeral 19, is provided with two apertures therethrough which receive the two terminal heater element legs. The connector is rigidly secured to the inside leg by an integrally formed boss or ring surrounding the corresponding aperture and crimped to the inside leg. The relatively more flexibly mounted outside leg is positioned against excessive longitudinal inward movement by a second ring or boss which is in the nature of a "break-away" member retained on the connector by small readily severed sections which break or part from the connector upon a crimping of this ring to the outside terminal leg. In this manner, the ring prevents longitudinal inward movement of the outside terminal leg, resisting any tendency for such movement upon a plugging-in of the heater assembly, and at the same time provides for an accommodation of movement through expansion and contraction during the various heating and cooling cycles. The "break-away" ring, thus provided, is a constant source of production line and tool problems due to the critical nature of the connection between the ring and the connector or ground bracket itself.

The patent to Drugmand et al., U.S. Pat. No. 3,644,710, is of interest in illustrating a heater assembly incorporating both a connector with a break-away boss or ring, and strap-like members which are welded to the convolutions and depend therefrom for engagement with the spider support.

SUMMARY OF THE INVENTION

It is the purpose of the present invention to provide for an improved electric surface heater assembly wherein the manner of assembling the components, and in particular the heating element, support spider, and connector or grounding bracket, eliminates all of the shortcomings associated with the above described conventional assemblies.

Basically, in the new assembly, the support spider freely underlies the convoluted central or intermediate planar heating portion of the tubular heating element and, while providing a support therefor, particularly when the convoluted heating portion is subjected to a superimposed load, is otherwise unattached thereto. The actual engagement of the support or spider with the heating element is effected through a bracket including a lower sleeve-like portion wrapped about the inside terminal leg, and an offset panel projecting upwardly from the sleeve-like portion into fixed engagement with an elongated diametrically extending central support arm.

The central support arm, to which the support mounting bracket is affixed, includes a laterally directed end adjacent the bracket which defines an abutment immediately behind the outer terminal leg of the heater element whereby inward movement of this leg under longitudinally generated pressures, as would be experienced during a "plugging-in" of the unit, is effectively resisted. Utilizing such an abutment enables elimination of the "break-away" ring on the connector, while still retaining the desired ability of the flexibly positioned terminal leg to freely move under the effects of expansion and contraction inherent in the heating and cooling of the assembly. Thus, while all of the advantages of the connector or grounding bracket have been retained, the problems associated therewith have been eliminated.

The support assembly, as proposed herein, provides for a consistently uniform flat surface for cooking purposes through the elimination of any procedures that deform the tube, and in particular the central heating portion thereof. Similarly, the assembly herein avoids any disruption in the planar surface by the extension of staking sections or the like thereabove.

The assembly herein also avoids any disruptions of the insulating material or the possibility of the "blow -holes" as are frequently encountered in the more common assemblies wherein the supports are welded to the tubes. This also greatly extends the average life of the assembly.

Additionally, the improved heater assembly, eliminating any direct fixing of the support to the convoluted portion of the heating element, eliminates any tendency for the occurrence of "cold spots." Basically, the structure proposed herein provides a finished surface for the heater assembly with no operation being preformed on the convoluted heating portion of the assembly after the initial formation of the tubular heating element itself. This ensures that the integrity of the heat transfer system is not compromised by subsequent staking or welding operations.

Additional objects and advantages of the invention are considered to reside in the details of construction and operation as more fully hereinafter described and claimed.

DESCRIPTION OF THE PREFERRED EMBODIMENT

Figure 1:
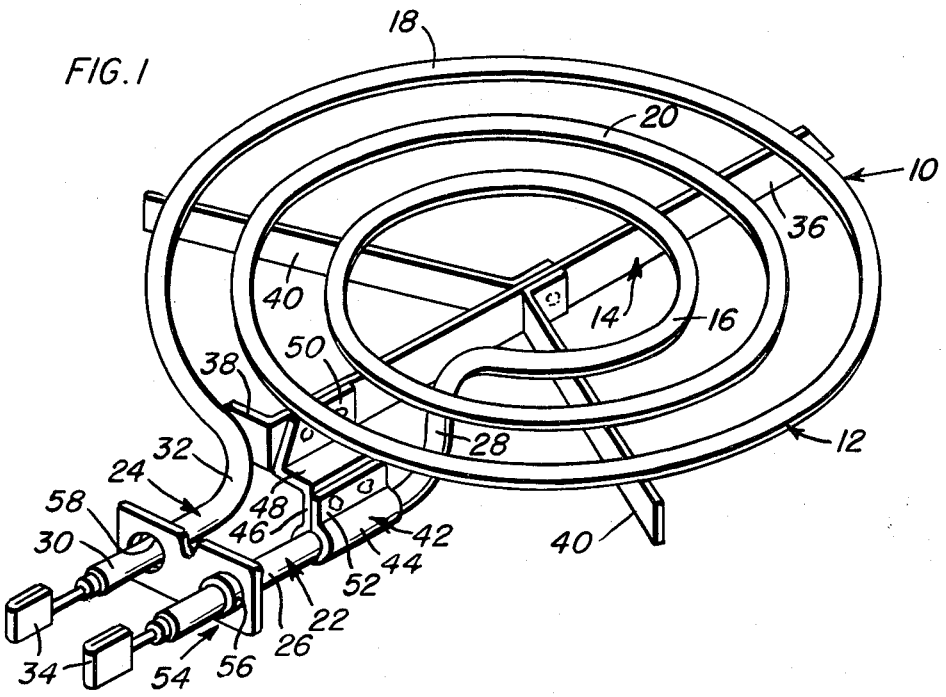
FIG. 1 is a perspective view of the surface heater assembly comprising the present invention.
Figure 2:
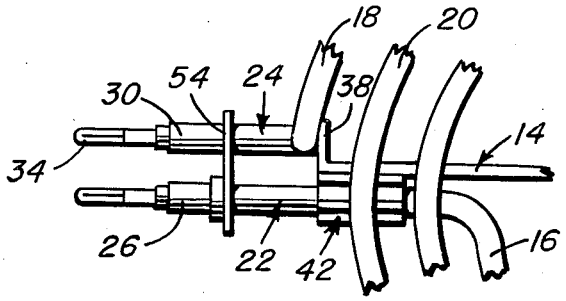
FIG. 2 is an enlarged partial plan view illustrating the area of connection between the tubular heating element and the support bracket.

Referring now more specifically to the drawings, reference numeral 10 is used to generally designate the surface heater assembly of the present invention. This assembly basically incorporates a conventionally formed tubular heating element 12 and a specifically configured support or support spider 14 associated therewith.

The tubular heating element 12 includes an intermediate planar heating portion defined by multiple concentric convolutions including an inner convolution 16, an outer convolution 18, and one or more intermediate convolutions 20. The inner and outer convolutions 16 and 18 terminate respectively in inside and outside terminal legs 22 and 24.

The inside leg 22 includes a horizontally projecting elongated terminal end portion 26 oriented in a plane spaced below the central heat generating convoluted portion, this end portion, through a generally vertical portion 28, forming an integral extension of the end of the inner convolution 16.

The outside leg 24 similarly includes a horizontally extending terminal end portion 30 located in laterally spaced relation to the terminal end portion 26 and in a common plane therewith below the plane of the central heating portion. This terminal end portion 30 constitutes, through a generally vertical portion 32, an integral extension of the outer convolution 18. Both terminal end portions, as will be readily appreciated, project radially beyond the outer periphery of the central heating portion 12 and mount terminal pins 34 at the outermost ends thereof.

The inside terminal leg 22 integral with the small diameter inner convolution 16, is relatively rigidly positioned. The outside terminal leg 24, extending from the largest diameter outer convolution 18, is, by the same token, relatively flexibly positioned, that is easily shiftable or moved relative to the leg 22 as well as the central heat generating portion 12. This flexible mounting of the leg 24 is of particular concern during the mounting of the heater assembly, at which time the terminal pins are forcibly inserted within an appropriate socket.

This undesirable longitudinal inward shifting of the outside terminal leg 24 is prevented by the support or support spider 14. The spider 14 includes a main or central arm 36 positioned diametrically across the heat generating convoluted central portion 12, immediately therebelow and in a vertical plane generally aligned between the two terminal end legs 22 and 24. This support arm 36 is in the nature of a rigid flat vertically positioned strip. A first end portion 38 of the arm 36 is laterally bent to provide an abutment surface positioned immediately inward of the vertical portion 32 of the terminal outside leg 24. The second end of the support arm 36, remote from the abutment forming end portion 38, extends to a diametrically opposed point slightly outward of the outer convolution 18. The support spider 14 is completed by a pair of radially extending arms 40, each of which includes a turned inner end portion welded or otherwise affixed to the central arm 36 at a central point therealong, and a second outer end projecting slightly beyond the outer convolution 18 at a point thereabout equally spaced from the second end of the other radial arm and the second end of the central arm. In this manner, full support is provided for the central heat generating portion along radiuses approximately 120 degrees apart, with additional support provided by the central arm from the point of engagement of the arms 40 therewith to the abutment defining end portion 38. As will be noted from the drawings, each of the support arms 40 is also in the nature of a flat vertically oriented rigid strip. The entire upper edge surface of the support spider 14 is flat or planar and, other than providing for a constant surface upon which the central convoluted section is supported, includes no projection, recesses, or other means for a positive fixing of the tubular element thereto.

Figure 3:
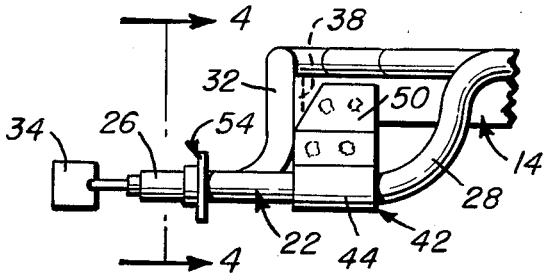
FIG. 3 is a side detail of the construction of FIG. 2.
Figure 4:
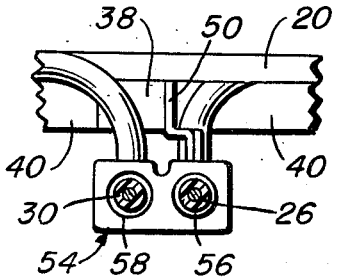
FIG. 4 is a cross-sectional elevation taken on a plane passing along 4—4 in FIG. 3.

The only interengagement between the spider 14 and the tubular heating element 12 is the bracket 42 positioned remote from the convoluted central portion. This bracket, defined by a relatively wide metal strip, includes a first lower end portion thereof wrapped around the terminal end portion 26 of the inside leg 22 to define an elongated sleeve 44 frictionally engaged with the tubular terminal end portion 26 adjacent or near the juncture between the terminal end portion 26 and the associated upwardly turned vertical interconnecting portion 28. Note in particular FIG. 3.

Projecting upwardly from the bracket sleeve 44 is a vertical panel 46 extending approximately to the height of the bottom of the support spider 14. A laterally directed offset or shoulder 48 extends integrally from the upper edge of the panel 46 and in turn terminates in an upwardly directed vertical flange 50 which lies against one vertical face of the central arm 36 for attachment, preferably by welding, thereto. As will be noted from the drawings, in the formation of the sleeve 44, an edge flange 52 is provided for welding or the like to the vertical bracket panel 46.

In installing the bracket 42, the bracket will be wrapped about the leg 22 to define the sleeve 44, after which the end flange 52 will be welded to the vertical panel 46 in a manner which allows rotational and longitudinal movement of the bracket for a proper alignment thereof with the central support arm 36. When properly aligned, the bracket will be welded to the central arm and the sleeve brought into firm frictional engagement with the terminal leg 22 to preclude further movement relative thereto. When applied, the bracket 42 provides for a positive association of the support spider 14 and the tubular heating element 12 without necessitating a gripping, welding, or other disruption of the heat generating convoluted central portion. The positioning of the bracket 42 immediately inward of the abutment forming end portion 38 provides for an additional stabilization of the entire assembly. Further, through the elongated nature of the bracket 42 and in particular the defined sleeve 44, the convoluted central portion of the tubular heating element 12 is easily maintained in parallel overlying relation to the upper surface of the spider 14, and in fact may be retained in slightly spaced overlying relation thereto in the absence of a superimposed load, such as from a cooking vessel. Such an arrangement will further reduce any tendency for dissipation of heat through the support spider.

As described above, the relatively flexibly mounted terminal leg 24 is stabilized against longitudinal inwardly directed movement, this being particularly significant in light of the forces to be introduced thereto upon a "plugging-in" of the assembly. Stabilization of the outside leg 24 against lateral displacement relative to the inside leg 22 is effected by a plate-like connector or grounding bracket 54 which includes a first aperture surrounded by an integral laterally projecting boss 56 receiving the terminal end portion 26 of the leg 22 therethrough. This boss is crimped to the terminal end portion 26, thereby locking the connector 54 thereto. A second aperture 58 through the connector 54 freely receives the terminal end portion 30 of the leg 24 therethrough. The aperture 58, while allowing some minor lateral shifting of the leg 24 relative to the leg 22, basically retains the laterally spaced parallel relationship. The slight lateral movement provided for enables a desired free movement of the legs in response to the anticipated expansion and contraction resulting from the heating and cooling of the tubular heating element. By the same token, while the abutment 38 stabilizes the leg 24 against excess longitudinal inward shifting thereof, it will be appreciated that this leg is also free for limited expansion and contracting in a longitudinal direction. This, in view of the nature of the assembly, is essential, and provision therefore in the above described manner is considered unique.

From the foregoing, it will be appreciated that a unique surface heater assembly has been defined wherien the desired relationship between the support spider and the tubular heating element, in particular the central heat generating convoluted portion thereof, is maintained without a direct interconnection between the support spider and the heat generating portion, thus avoiding any disruption of either the planar upper surface of the heat generating portion or the electrical heat generating means incorporated therein. By the same token, there has been described a simplified although highly unique means for accommodating the relatively flexibly mounted outside terminal leg while maintaining the relationship between the two terminal legs and allowing for the necessary expansion and contraction of the tubular element.

The foregoing is considered illustrative of the principles of the invention. It is contemplated that the claims encompass all suitable modifications, variations, and equivalents which fall within the scope of the invention as claimed.

We claim:

1. An electric surface heater assembly comprising a tubular heating element and a support spider, said heating element comprising a generally planar central heating portion defined by multiple convolutions including an outer convolution and an inner convolution with outer and inner terminal legs extending respectively therefrom, said terminal legs including terminal end portions offset below the central heating portion and extending in lateral spaced relation to each other, and depending vertical shoulder portions between said terminal end portions and the respective inner and outer convolutions, said spider defining a support means for the central heating portion, said central heating portion freely overlying said spider, and a bracket securing said spider to said heating element remote from the central heating portion, said bracket being positioned solely between and secured to the inner terminal leg and said spider, said bracket including an elongated sleeve encircling the terminal end portion of said inner terminal leg, and a panel portion projecting vertically from said sleeve to said spider.

2. The heater assembly of claim 1 wherein said spider includes an abutment aligned with and freely engaged against the shoulder portion of the outer terminal leg to preclude longitudinal inward movement of this leg relative to said spider and the overlying central heat generating portion.

3. The heater assembly of claim 2 including a connector between the terminal end portions of the outer and inner terminal legs, means fixing said connector to said inner terminal leg against movement relative thereto, said connector including an aperture defined therethrough, said outer terminal leg being longitudinally received through said aperture for retention by said connector against lateral dislocation relative to said inner terminal leg, said outer terminal leg being unrestrained by said connector against longitudinal movement relative thereto.

4. The heater assembly of claim 3 wherein the vertically projecting panel portion of said bracket includes a lateral offset therein in spaced relation above said sleeve, and a vertical flange extending upwardly from said offset into engagement with said spider.

5. The heater assembly of claim 4 wherein said spider includes an elongated arm underlying said central heating portion and extending diametrically thereof generally in a vertical plane aligned between said terminal legs, said arm having a laterally turned end adjacent and immediatey inward of the outer terminal leg, said laterally turned end defining said abutment.

6. An electric surface heater assembly comprising a tubular heating element and a support spider, said heating element comprising a generally planar central heating portion defined by multiple convolutions including an outer convolution and an inner convolution with outer and inner terminal legs extending respectively therefrom, said terminal legs including terminal end portions offset below the central portion and extending in lateral spaced relation to each other, and depending vertical shoulder portions between said terminal end portions and the respective inner and outer convolutions, said spider defining a support means for the central heating portion, and means between one of said terminal legs and the spider securing the spider to the heating element in underlying relation to the central heating portion, said spider including an elongated arm underlying said central heat generating portion and extending diametrically thereof generally in a vertical plane aligned between said terminal legs, said arm having an abutment adjacent and immediately inward of the other of said terminal legs, said abutment being aligned with and freely engaged against the shoulder portion of the other of said terminal legs to preclude inward movement of this leg relative to said spider while allowing substantially free expansion and contraction movement thereof.

7. The heater assembly of claim 6, including a connector between the terminal end portions of the outer and inner terminal legs, means fixing said connector to said inner terminal leg against movement relative thereto, said connector including an aperture defined therethrough, said outer terminal leg being longitudinally received through said aperture for retention by said connector against lateral dislocation relative to said inner terminal leg, said outer terminal leg being unrestrained by said connector against longitudinal movement relative thereto.

8. The heater assembly of claim 6 wherein said abutment is defined by a laterally turned end on said elongated arm.

9. An electric surface heater assembly comprising a tubular heating element and a support spider, said heating element comprising a generally planar central heating portion defined by multiple convolutions including an outer convolution and an inner convolution with outer and inner terminal legs extending respectively therefrom, said terminal legs including terminal end portions offset below the central portion and extending in lateral spaced relation to each other, and depending vertical shoulder portions between said terminal end portions and the respective inner and outer convolutions, said spider defining a support means for the central heating portion, said central heating portion freely overlying said spider, and a bracket securing said spider to said heating element, said bracket being positioned between and secured to the terminal end portion of the inner terminal leg and said spider, said spider including an abutment aligned with and freely positioned against the shoulder portion of the outer terminal leg to preclude longitudinal inward movement of the terminal end portion of the outer terminal leg relative to said spider and the overlying central heat generating portion.

10. The heater assembly of claim 9 wherein said spider includes an elongated arm underlying said central heat generating portion and extending diametrically thereof generally in a vertical plane aligned between said terminal legs, said arm having a laterally turned end adjacent and immediately inward of the outer terminal leg, said laterally turned end defining said abutment.

11. The heater assembly of claim 9 wherein said bracket includes an elongated sleeve encircling the terminal end portion of said inner terminal leg, and a panel portion projecting vertically from said sleeve to said spider.

* * * * *